US006764420B2

(12) United States Patent
Cyr et al.

(10) Patent No.: US 6,764,420 B2
(45) Date of Patent: Jul. 20, 2004

(54) DETACHABLE NOCK FOR DETACHING A LOCATOR FROM AN ARROW

(75) Inventors: Maurice Cyr, Hampden, ME (US); Jon Simms, Hampden, ME (US)

(73) Assignee: Talon Industries, LLC, Hampden, ME (US)

( * ) Notice: Subject to any disclaimer, the term of this patent is extended or adjusted under 35 U.S.C. 154(b) by 338 days.

(21) Appl. No.: 10/094,907

(22) Filed: Mar. 12, 2002

(65) Prior Publication Data

US 2003/0176245 A1 Sep. 18, 2003

(51) Int. Cl.[7] ..... F42B 6/04
(52) U.S. Cl. ..... 473/578; 455/98
(58) Field of Search ..... 473/569, 570, 473/571, 578, 586; 342/386; 455/98

(56) References Cited

U.S. PATENT DOCUMENTS

| | | | | | |
|---|---|---|---|---|---|
| 3,865,374 | A | * | 2/1975 | Troncoso, Jr. | 473/578 |
| 4,749,198 | A | * | 6/1988 | Brailean | 473/570 |
| 4,836,557 | A | * | 6/1989 | Polando | 473/578 |
| 4,858,935 | A | * | 8/1989 | Capson | 473/570 |
| 4,885,800 | A | * | 12/1989 | Ragle | 455/98 |
| 4,940,245 | A | * | 7/1990 | Bittle, Jr. | 473/570 |
| 4,976,442 | A | * | 12/1990 | Treadway | 473/570 |
| 5,157,405 | A | * | 10/1992 | Wycoff et al. | 342/386 |
| 5,167,417 | A | * | 12/1992 | Stacey et al. | 473/570 |
| 5,188,373 | A | * | 2/1993 | Ferguson et al. | 473/583 |
| 5,333,881 | A | * | 8/1994 | Cugliari | 473/578 |
| 5,446,467 | A | * | 8/1995 | Willett | 342/386 |
| 6,409,617 | B1 | * | 6/2002 | Armold | 473/578 |
| 6,612,947 | B2 | * | 9/2003 | Porter | 473/578 |
| 2003/0132846 | A1 | * | 7/2003 | Hilliard | 340/573.2 |

* cited by examiner

*Primary Examiner*—John M. Hotaling, II
(74) *Attorney, Agent, or Firm*—Anthony D. Pellegrini, Esq

(57) ABSTRACT

A detachable nock for use with a bow hunting arrow carrying a locating device within its hollow shaft. The detachable nock engages with the target animal and removes the locating device from the arrow shaft as the arrow passes through the target animal, thereby retaining the locating device with the animal to permit tracking. The detachable nock may be constructed with various fixed or movable retention components to accommodate the needs of a wide range of hunters. The design of the detachable nock minimizes its impact on the flight of the arrow and allows the bow hunter to use any style of hollow-shaft arrow, broadhead, and fletching.

46 Claims, 7 Drawing Sheets

DETACHABLE NOCK FOR DETACHING A LOCATOR FROM AN ARROW

BACKGROUND OF THE INVENTION

1. Technical Field

The invention relates generally to bow hunting for game animals and more particularly to the use of a detachable device used in combination with an arrow-mounted locating device to track and locate a wounded animal.

2. Description of Prior Art

Arrow-mounted tracking devices, and in particular arrow-mounted transmitting devices, are well known in the industry. Several devices have been developed for tracking and locating game animals that have been wounded by bow hunters. These devices range from trailing a string or thread from an arrow, releasing paint or smoke from an arrow, and equipping an arrow with an electronic transmitting device. U.S. Pat. No. 4,704,612, dated Nov. 3, 1987, to Dan D. Boy, and reissued as U.S. Pat. No. Re.33,470, dated Dec. 4, 1990, discloses a method and apparatus for tracking an animal using an electronic transmitting device contained within an arrow shaft. While the Boy invention is an improvement over mechanical devices, such as arrows trailing string or thread which can become tangled or broken and which have limited range, and over chemical devices, such as paint or smoke emitting arrows which can be difficult to follow through thick underbrush or may be dispersed by wind, it nevertheless has a significant drawback. Modern compound and recurve bows used to hunt deer, bear, turkey, and other game animals typically shoot an arrow completely through the game animal at ranges of up to 45 yards. If the arrow passes completely through the game animal, which is the preferred method for killing a game animal with an arrow, the transmitting device will not work to track the wounded animal, but will merely provide the location of the spent arrow. U.S. Pat. No. 5,446,467, dated Aug. 29, 1995, to Eugene M. Willett, which discloses a detachable dart affixed to the exterior of an arrow and containing a transmitting device, which dart detaches from the arrow and remains attached to the wounded animal upon impact, theoretically avoids the disadvantage of the Boy invention but introduces another deficiency in that the size, weight, and position of the externally attached dart (along with its required counterweight) negatively impacts the flight of the arrow and reduces the accuracy of the arrow's flight, making it an unattractive alternative to a bow hunter. U.S. Pat. No. 4,976,442, dated Dec. 11, 1990, to Woodrow L. Treadway, discloses an apparatus in which a transmitting device is located within the hollow shaft of an arrow and is removable therefrom through a notch cut into the arrow shaft, such that upon impact with an animal the transmitting device remains attached to the wounded animal irrespective of the ultimate location of the spent arrow. The Treadway apparatus, by enclosing the bulk of the removable transmitting device within the arrow shaft, does not, in theory, cause the severe degree of negative impact to the flight of the arrow and the corresponding reduction in the accuracy of the arrow's flight seen in the Willett invention; however, the notch cut into the arrow shaft requires archery hunters to use specially designed arrow shafts, at increased cost, rather than their preferred model, and the loss of a spent arrow which has passed through an animal entails the loss of the expensive custom designed shaft. The device claimed herein seeks to reduce these deficiencies.

It is an object of this invention to provide a new and improved detachable device for use with an arrow-mounted locating device which is designed to attach the locating device to a game animal upon impact when the arrow passes through the animal, while minimizing the impact of the detachable device and locating device on the flight of the arrow, and allowing bow hunters to use their preferred model of arrow shaft rather than an expensive custom designed arrow shaft.

SUMMARY

In one aspect, the invention is directed to a device for removing a locating device contained within the hollow shaft of an arrow from the arrow and securing the locating device to a game animal, comprising a detachable nock having a nock body, a vertical notch to receive a bow string, an attachment component for removably attaching the detachable nock to the arrow shaft, an anchor component for fixedly attaching the locating device to the detachable nock, and a retention component for securing the detachable nock to the game animal, whereby the retention component engages and lodges into the game animal and in combination with the anchor component removes the locating device from the arrow and secures the locating device to the game animal.

This aspect may include one or more of the following features: the attachment component having a substantially cylindrical or tapered shape to be removably attached to the arrow shaft directly or into an adapter fitted into the arrow shaft; the anchor component having a loop attached to the attachment component to which is attached an anchor wire which in turn is attached to the locating device; the anchor component having an aperture through the attachment component, with or without side channels, through which the anchor wire is passed and which in turn is attached to the locating device; the anchor component having an aperture passing through the front and out the top of the attachment component and an anchor bead situated within the aperture and in connection with the anchor wire which in turn is attached to the locating device; the anchor component having interlocking parts allowing for quick and simple attachment and detachment of the detachable nock to the locating device; the anchor wire serving as an antenna for the locating device; the retention component having one or more fixed hooks for engaging and lodging into the target; the retention component having one or more hinged hooks for engaging and lodging into the target; the retention component having one or more barb guards; the retention component having one or two flexing hooks situated within a hook slot formed within the nock body with the hook barbs pointed forward and concealed within the slot until force of contact pushes the barbs out of the slot to engage the target; the retention component having a pivoting grabber employing one or more grabbing arms which are concealed within a slot until engaged upon impact with the target, whereupon the grabbing arms pivot to extend beyond the slot to engage and lodge into the target; the retention component having a grabbing arm consisting of a barbed hook; the retention component having a pivoting grabber employing grabbing arms which are twisted along their longitudinal axes such that the twisted shape of the grabbing arms cause the entire detachable nock to spin when the grabbing arms are extended to the open position; the retention component being integrated into the nock body; and the retention component being integrated into an extension inserted between the nock body and the attachment component.

In another aspect, the invention is directed to a device for removing a locating device contained within the hollow shaft of an arrow from the arrow and securing the locating device to a game animal, comprising a detachable nock having a nock body, a vertical notch to receive a bow string, and an attachment component for removably attaching the detachable nock to the arrow shaft, a retention device for securing the locating device to the game animal, and an anchor component for attaching the locating device to the retention device, whereby the retention device engages and lodges into the game animal and in combination with the anchor component removes the locating device from the arrow and secures the locating device to the game animal.

This aspect may include one or more of the following features: the retention device having one or more removable hooks situated alongside the attachment component of the detachable nock and held in position between the attachment component and the interior of the arrow shaft; the removable hooks having barbed ends directed forward toward the arrow head; and the detachable nook having one or more channels or slots to accommodate the shafts of the removable hooks.

In another aspect, the invention uses a guidance component to guide the locating device cleanly out of the arrow shaft.

Other features and advantages of the invention are described below.

DESCRIPTION OF THE INVENTION

Figure 1:
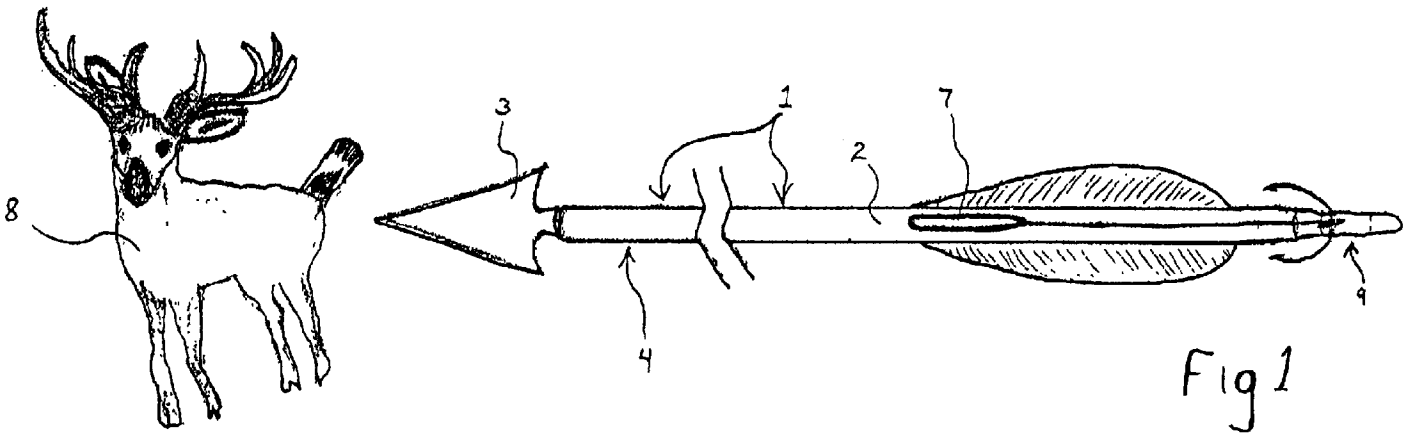
FIG. 1 is a cut-away view of an arrow, showing the interior of the arrow shaft containing a locating device and a detachable nock inserted into the end of the arrow shaft.
Figure 2:
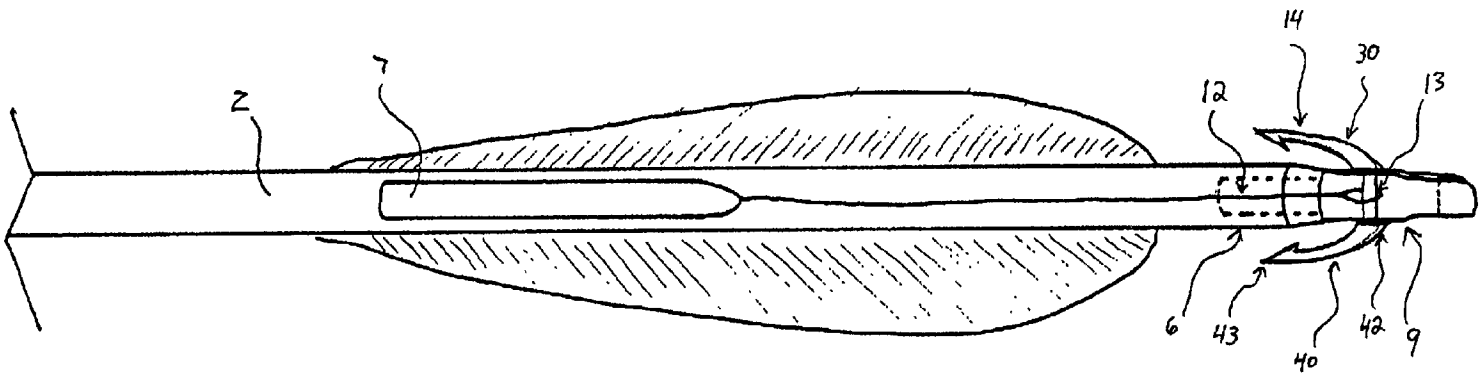
FIG. 2 is a detailed cut-away view of the arrow shown in FIG. 1.
Figure 3:
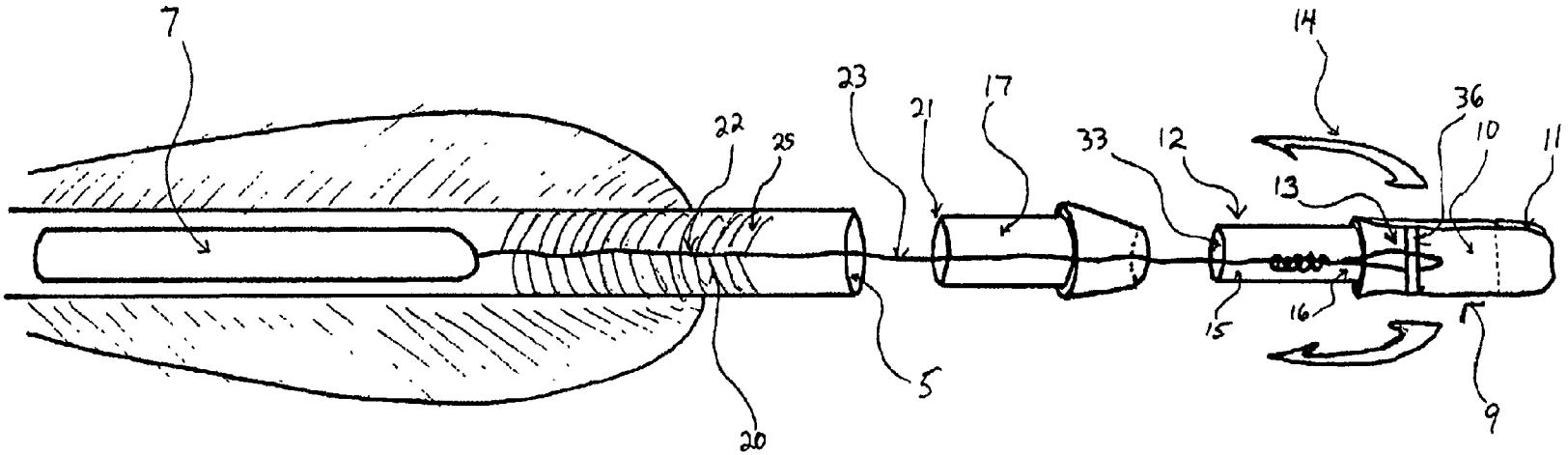
FIG. 3 is an exploded view of the detachable nock shown in FIG. 2 along with the arrow shaft and a nock adapter.

FIGS. 1 through 3 show perspective views of one embodiment of a detachable nock 9 as it is intended to be used with an arrow 1 and a locating device 7. The arrow 1, which is not claimed, has a hollow shaft 2 and an arrowhead 3 situated at the front end 4 of the arrow shaft 2 and an aperture 5 situated at the rear end 6 of the arrow shaft 2. The locating device 7, which is not claimed, is designed to fit into the hollow shaft 2 of the arrow 1 and to be removed from the arrow 1 through the arrow aperture 5. The detachable nock 9 is used to remove the locating device 7 from the arrow 1 and to secure the locating device 7 to a target 8. When the arrow 1 strikes the target 8 and continues on its flight path through the target 8, the detachable nock 9 engages the target 8 and detaches from the arrow 1, causing the locating device 7 to also be removed from the arrow 1, resulting in the locating device 7 remaining attached to the target 8 to effect the goal of assisting in locating the target 8. This enhances the possibility that the locating device 7 will remain with the target 8 even though the arrow 1 has passed through the target 8, thereby allowing the locating device 7 to be used to track the target 8 and not the spent arrow 1. The detachable nock 9 includes a nock body 10, a vertical notch 11 to receive a bow string situated at the rear of the detachable nock 9, an attachment component 12 for removably attaching the detachable nock 9 to the arrow shaft 2, an anchor component 13 for attaching the locating device 7 to the detachable nock 9, and a retention component 14 for securing the detachable nock 9 to the target 8. The retention component 14 engages and lodges into the target 8 as the arrow 1 passes through the target 8 and continues on its flight path, and in combination with the anchor component 13 removes the locating device 7 from the arrow 1 and secures the locating device 7 to the target 8. In all embodiments the nock body 10, attachment component 12, and vertical notch 11 form an integrated unit, with no clear delineation between the components. These three components taken together resemble nocks that are readily available in the industry.

One embodiment of the attachment component 12 of the detachable nock 9 is shown in FIG. 3. It is an extension of the nock body 10 projecting from the front of the nock body 10 and aligned longitudinally with the intended direction of the flight of the arrow 1. It may have a substantially cylindrical shape or a tapered shape, to facilitate insertion into the arrow 1. The end of the attachment component 12 nearest the nock body 10 is designated the base end 16 and is integrated into the nock body 10. The end of the attachment component 12 furthest from the nock body 10 is designated the insertion end 15. If the attachment component 12 is tapered, the base end 16 is wider than the insertion end 15. The attachment component 12 may be inserted, insertion end 15 first, directly into the arrow aperture 5, or into a nock adapter 17, not claimed, which is fitted into the arrow aperture 5 in order to accommodate arrow shafts 2 with different inside diameters. The diameter of the attachment component 12 must be just slightly less than the inside diameter of the arrow aperture 5 or the nock adapter 17 aperture, so that the attachment component 12 is secured by friction to the arrow aperture 5 or nock adapter 17 by an application of an appropriate force directing the detachable nock 9 into the arrow shaft 2. This is a common method for attaching a nock to an arrow shaft. In this case, an appropriate force is such force that secures the detachable nock 9 firmly to the arrow 1, so that the detachable nock 9 does not move with respect to the arrow shaft 2 while the arrow 1 is at rest or in flight, yet permits an opposing force generated by the impact of the detachable nock 9 with the target 8 to overcome the friction of the attachment component 12 within the arrow aperture 5 or nock adapter 17, thereby causing the detachable nock 9 to detach from the arrow 1.

One embodiment of the anchor component 13 of the detachable nock 9 is shown in FIG. 3. In this embodiment, the anchor component 13 includes a central aperture 33 through the insertion end 15 of the attachment component 12 and terminating within the detachable nock 9, a retaining pin 36 securely situated within the central aperture 33, and an anchor device 19. The central aperture 33 is situated substantially coaxially with the longitudinal axis of the attachment component 12. It has a substantially cylindrical shape, with a uniform inside diameter. The open end 34 of the central aperture 33 is situated at the front of the attachment component 12 allowing for communication through the central aperture 33 to the exterior of the attachment component 12. The terminal end 35 of the central aperture 33 is situated within the interior of the detachable nock 9 and at the opposite end of the central aperture 33 as the open end 34. The retaining pin 36 is situated substantially perpendicular to the central aperture 33. It may be fixedly embedded within the detachable nock 9 or removably secured. The end of the retaining pin 36 situated within the central aperture 33 is designated the retaining end 38, and should be positioned within the terminal end 35 of the central aperture 33. If the retaining pin 36 is movably secured to the detachable nock 9, the end opposite the retaining end 38, designated the placement end 37, is adapted to accommodate a screwdriver or other like device, and the retaining pin 36 is threaded, as is an aperture 29 within the detachable nock 9 into which the retaining pin 36 is inserted. In this embodiment, one end of the anchor device 19, which may be a wire, is inserted into the open end 34 of the central aperture 33 and attached directly to the retaining pin 36, and the other end is attached to the locating device 7, thereby securing the locating device 7 to the detachable nock 9.

In another embodiment of the anchor component 13, not shown, one end of the anchor device 19 is attached to an anchor bead 39 having a spherical shape and a diameter just slightly smaller than the inside diameter of the central aperture 33, and the other end of the anchor device 19 is attached to the locating device 7. The anchor bead 39 is positioned within the terminal end 35 of the central aperture 33 behind the retaining pin 36 such that the retaining end 38 of the retaining pin 36 is situated between the anchor bead 39 and the open end 34 of the central aperture 33, preventing the anchor bead 39, which is larger than the spaces on either side of the retaining pin 36, from exiting the central aperture 33. In this embodiment the retaining pin 36 should be threaded to allow it to be inserted into and removed from the central aperture 33 for ease of positioning the anchor bead 39. This embodiment has the advantage of allowing different locating devices 7 to be attached to the detachable nock 9 quickly and securely.

In yet another embodiment of the anchor component 13, not shown, the anchor component includes both the central aperture 33 as described above and an entry aperture 111 through the insertion end 15 of the attachment component 12. The entry aperture 111 is situated substantially perpendicular to the central aperture 33 and has a substantially cylindrical shape, an open end 112 situated at the surface of the attachment component 12 allowing for communication through the entry aperture 111 to the exterior of the attachment component 12, a terminal end 113 situated within the interior of the attachment component 12 and at the opposite end of the entry aperture 111 as the open end 112, being coextensive with the terminal end 35 of the central aperture 33. The entry aperture 111 should have a uniform inside diameter slightly greater than the diameter of the central aperture 33. This embodiment also includes an anchor bead 39 which has a spherical shape and a diameter just slightly greater than the inside diameter of the central aperture 33 and just slightly smaller than the inside diameter of the entry aperture 111, such that the anchor bead 39 may be placed into the terminal end 113 of the entry aperture 111, but the anchor bead 39 cannot pass through the central aperture 33. The anchor device 19 is placed into the central aperture 33 through its open end 34 and attached to the anchor bead 39 situated within the terminal end 113 of the entry aperture 111, such that the anchor bead 39 secures the anchor device 19 to the detachable nock.

In yet another embodiment of the anchor component 13, not shown, the anchor component 13 includes a loop 18 attached to the insertion end 15 of the attachment component 12, and an anchor device 19. The loop 18 may be made of wire or may be made of a rigid material, and may have a substantially circular shape, with a diameter smaller than the diameter of the insertion end 15 of the attachment component 12, so that it does not interfere with the insertion of the attachment component 12 into the arrow 1. It may also be integrated into the insertion end 15 of the attachment component 12. One end of the anchor device 19, which may be a wire, is attached to the loop 18, and the other end is attached to the locating device 7.

In yet another embodiment of the anchor component 13, not shown, the anchor component 13 includes an anchor aperture 24 passing through the insertion end 15 of the attachment component 12, and an anchor wire 28. The anchor aperture 24 is situated substantially perpendicular to the longitudinal axis of the attachment component 12 and has openings 26, 27 situated on the surface of the insertion end 15 of the attachment component 12. One end of the anchor wire 28 is placed through the anchor aperture 24 and secured to itself, and the other end of the anchor wire 28 is attached to the locating device 7. In this embodiment, the attachment component 12 may include two parallel channels 31, 32, situated parallel to the longitudinal axis of the attachment component 12 and running from the openings 26, 27 of the anchor aperture 24 to the insertion end 15 of the attachment component 12, in order to accommodate the anchor wire 28 such that the thickness of the anchor wire 28 is completely contained within the parallel channels 31, 32 and the anchor aperture 24 and the anchor wire 28 does not extend beyond the surface of the attachment component 12.

In yet another embodiment of the anchor component 13, not shown, the anchor component 13 includes two interlocking parts 108, 109, the first part 108 which is attached to the attachment component 12 and the second part 109 which is attached to the locating device 7. The first interlocking part 108 attaches removably to the second interlocking part 109, allowing the detachable nock 9 to be easily and quickly attached or detached from the locating device 7. The two interlocking parts 108, 109 may be removably attached to each other by means of a threaded projection and a threaded aperture designed to receive the threaded projection, or a tab in a slot, or a hook and eye, or by magnets, or by any other suitable means.

In any of the foregoing embodiments of the anchor component 13, the anchor device 19 may serve as an antenna 23 for the locating device 7 if the locating device 7 is a type of electronic transmitter.

One embodiment of the retention component 14 of the detachable nock 9 is shown in FIG. 2. The retention component 14 is comprised of a fixed hook 40 fixedly attached to the detachable nock 9 in such a manner as the fixed hook 40 can engage and lodge into the target 8 upon contact. The fixed hook 40 includes a shaft 41, an attachment end 42, and a barbed end 43. The fixed hook 40 is fixedly attached to the nock body 10 at its attachment end 42. The shaft 41 of the fixed hook 40 is curved towards the front of the detachable nock 9, forming a bend 30, so that the barbed end 43 of the fixed hook 40 is forwardly directed towards the arrowhead 3. The fixed hook 40 lies substantially in a plane aligned with the intended direction of the flight of the arrow 1. In this embodiment, there may be several fixed hooks 40 arrayed about the detachable nock 9. This embodiment is the simplest and has the highest level of effectiveness, as the retention component 14 is always in a position to engage a target 8.

Figure 4:
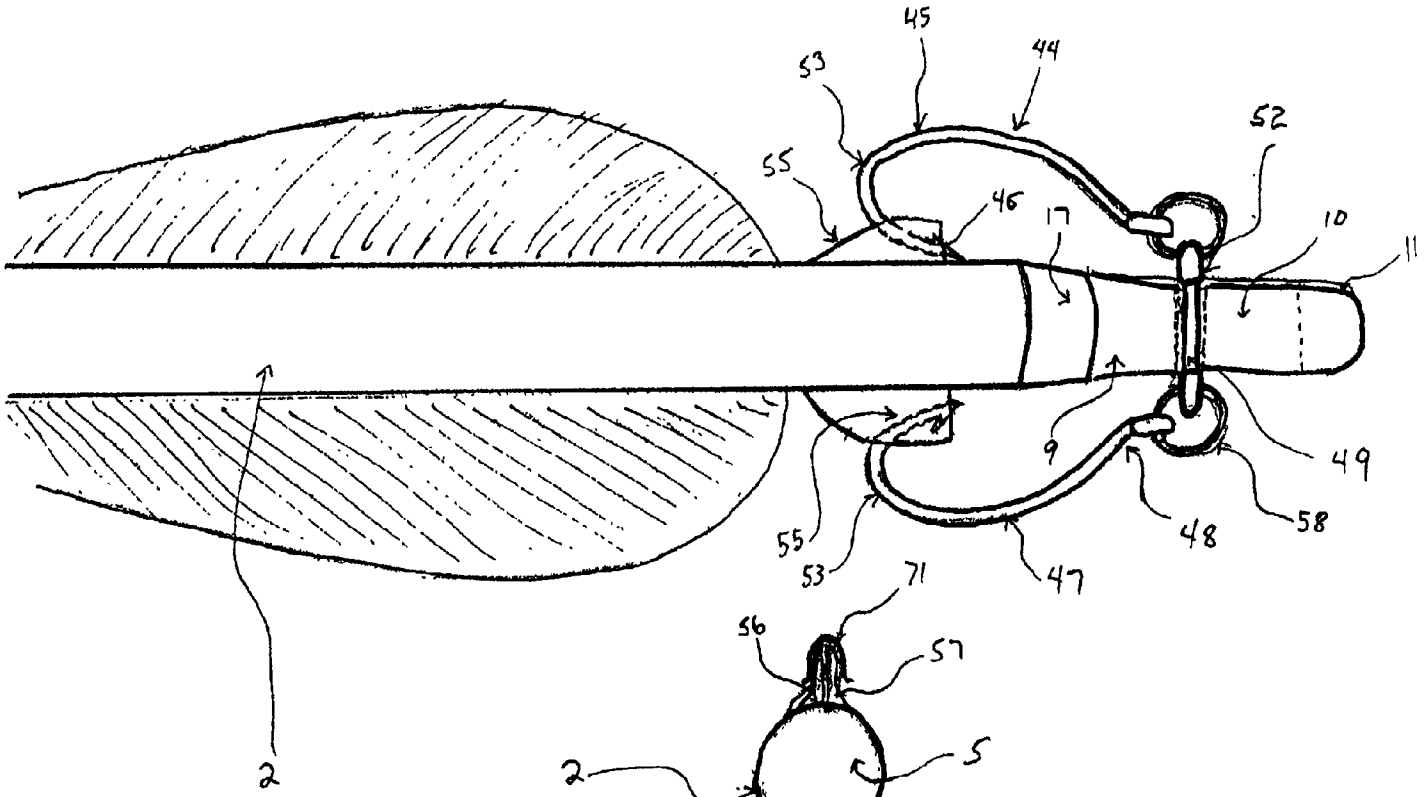
FIG. 4 is a perspective view of the detachable nock employing hinged hooks and barb guards.

Another embodiment of the retention component 14 of the detachable nock 9 is shown in FIG. 4. The retention component 14 is comprised of a hinged hook 44. The hinged hook 44 includes a grabbing prong 45 and an anchor pin 49. The grabbing prong 45 is a curved hook having a barbed end 46, a shaft 47, and a hinged end 48. The anchor pin 49 has two ends 50, 51, with one end 50 fixedly attached to the nock body 10 and the other end 51 serving as a hinge point 52. The grabbing prong 45 is movably attached to the hinge point 52 of the anchor pin 49 at its hinged end 48 in such a manner as permits the grabbing prong 45 to pivot forward and backward in a plane aligned with the intended direction of the flight of the arrow 1. The grabbing prong 45 may be attached to the anchor pin 49 by a small circular ring 58 passing through apertures 59 situated in the hinged end 48 of the grabbing prong 45 and in the hinge point 52 of the anchor pin 49. The shaft 47 of the grabbing prong 45 is curved forming a bend 53, so that the barbed end 46 of the grabbing prong 45 is directed substantially towards the hinged end 48 of the grabbing prong 45. When positioned for shooting the arrow 1, the grabbing prong 45 is positioned with its barbed end 46 directed towards the detachable nock 9 or, if the shaft 47 is sufficiently long, towards the arrow shaft 2. The bend 53 of the shaft 47 then serves as a contact point with the target 8. When the bend 53 of the shaft 47 contacts the target 8, the grabbing prong 45 is pivoted rearward, opposite the direction of the flight of the arrow 1, causing the barbed end 46 of the grabbing prong 45 to pivot away from the detachable nock 9 (or the arrow shaft 2), exposing the barb 46 to the target 8 and engaging and lodging into the target 8. In this embodiment, a torsion spring 54 may be integrated into the hinged end 48 of the grabbing prong 45 and the hinge point 52 of the anchor pin 49 so that the grabbing prong 45 is held in a forward position until it contacts the target 8. In this embodiment, there may be several hinged hooks 44 arrayed about the detachable nock 9. When only two hinged hooks 44 are used, the anchor pin 49 may extend completely through the nock body 10 and have hinge points 52 at both ends 50, 51. In this embodiment, there is a perpendicular aperture 61 through the nock body 10 situated substantially perpendicular to the longitudinal axis of the nock body 10, and the anchor pin 49 is inserted into the perpendicular aperture 61 such that its two hinge point 52 extend from the nock body 10. The two hinged hooks 44 are then attached to either end of the anchor pin 49. The anchor pin 49 may be made of either a rigid or a flexible material. The use of hinged hooks 44 permits the barbed ends 46 of the hooks 44 to be positioned out of the way, improving safety for the user.

Figure 5:
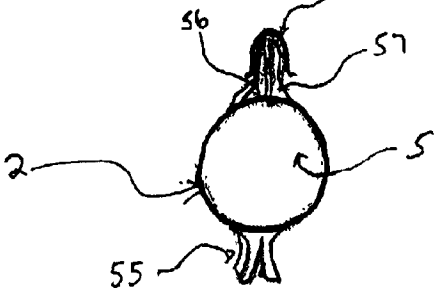
FIG. 5 is a cross-sectional view of the arrow shaft and barb guards shown in FIG. 4.

The embodiments of the retention component 14 of the detachable nock 9 which use hinged hooks 44 may also use barb guards 55 to further protect the user of the device from the barbed ends of the hinged hooks 44. One embodiment of barb guards 55 is shown in FIG. 5. In this embodiment, the barb guard 55 is comprised of two guard walls 56, 57 situated adjacent and parallel to each other, with a small separation between them to accommodate the barbed end 46 of a hinged hook 44. Each guard wall 56, 57 is composed of a semi-rigid material and can be of any appropriate shape, provided it has at least one straight edge. The two guard walls 56, 57 are attached along their straight edges perpendicularly to the detachable nock 9 in front of the hinged hook 44, and are situated substantially parallel to a plane aligned with the intended direction of the flight of the arrow 1. If the hinged hook 44 has a longer shaft 47, the guard walls 56, 57 may be attached perpendicularly to the arrow shaft 2 instead. When preparing the device for use, the user positions the barbed end 46 of the hinged hook 44 between the two guard walls 56, 57, thereby preventing the barbed end 46 to engage until it contacts the target 8. The barb guard 55 may also use a device for maintaining the barbed end 46 of the hinged hook 44 between the guard walls 56, 57 until the target 8 is engaged. Such a device may be a removable clip 71 situated over and compressing together the two guard walls 56, 57. When contact is made with the target 8 the removable clip 71 disengages from the guard walls 56, 57 and permits the hinged hook 44 to pivot out from between the guard walls 56, 57 and engage the target 8. There should be as many barb guards 55 as necessary to accommodate the number of hinged hooks 44 employed.

Figure 7:
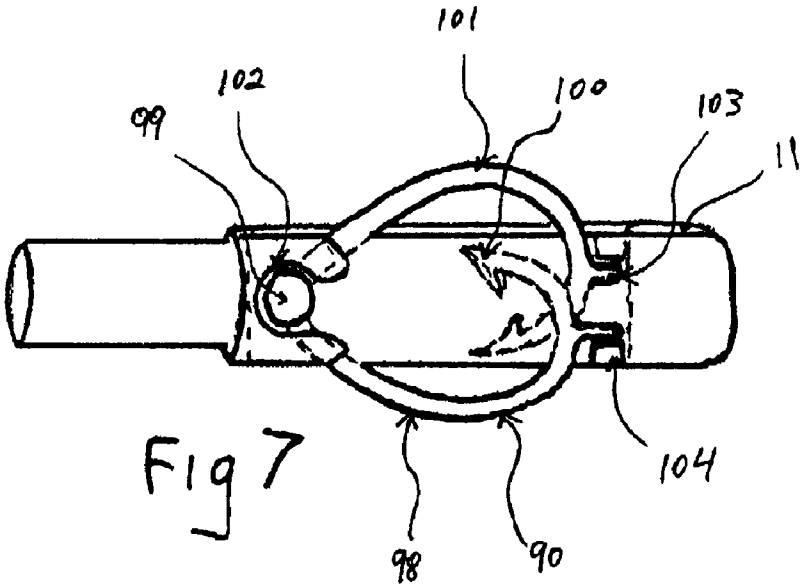
FIG. 7 is a side cut-away view of the detachable nock shown in FIG. 6.
Figure 6:
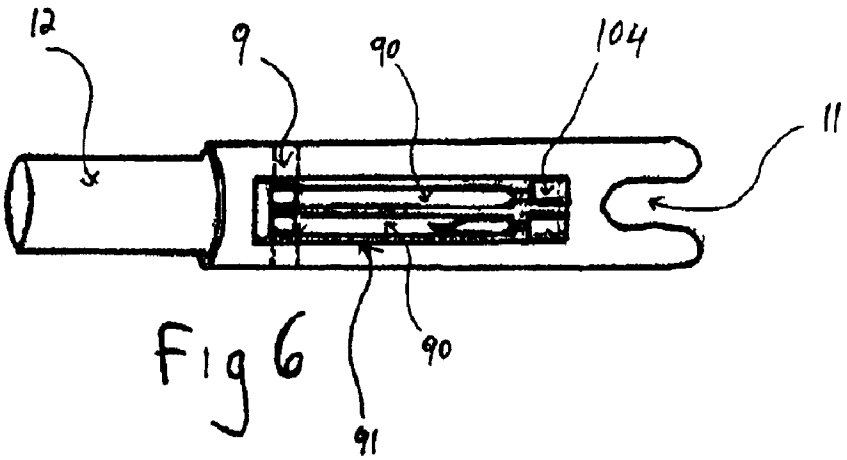
FIG. 6 is a top view of the detachable nock using flexing hooks within a slot.

Yet another embodiment of the retention component 14 of the detachable nock 9 is shown in FIGS. 6–7. In this embodiment, the retention component 14 is situated substantially within the interior of the detachable nock 9 and includes a flexing hook 90 and a hook slot 91. Because the retention component 14 is situated substantially within the interior of the detachable nock 9, the user is protected when handling the detachable nock 9 or shooting the arrow 1. The hook slot 91 is formed into the interior of the detachable nock 9, and has a left side 92, a right side 93, a front side 94, a back side 95, a top side 96, and a bottom side 97, with the left side 92, right side 93, front side 94, and back side 95 being solid surfaces and the top side 96 and bottom side 97 being open. The six sides 92, 93, 94, 95, 96, 97 define an open space aligned longitudinally with the intended direction of the flight of the arrow 1. The hook slot 91 should have a uniform width between the left side 92 and the right side 93 and a uniform length between the front side 94 and the back side 95. The flexing hook 90 includes a shaft 98, an attachment end 99, and a barbed end 100. The shaft 98 of the flexing hook 90 is curved back toward itself forming a bend 101, such that the barbed end 100 of the flexing hook 90 is directed generally towards the attachment end 99 of the flexing hook 90. The flexing hook 90 is attached to the front side 94 of the hook slot 91 at its attachment end 99. Most of the flexing hook 90 is contained within the hook slot 91, including its barbed end 100, which is directed towards the front end 4 of the arrow 1, but a portion of the shaft 98 of the flexing hook 90 containing the bend 101 is exposed externally from the hook slot 91. The flexing hook 90 is fashioned of a flexible material allowing it to flex about its attachment end 99 when a force is applied to the bend 101 in its shaft 98. As a force is applied to the bend 101 of the shaft 98, that portion of the flexing hook 90 is forced into the hook slot 91 and the barbed end 100 of the flexing hook 90 emerges from the opposite side of the hook slot 91, where it engages and lodges into the target 8. When the force is removed from the bend 101 of the shaft 98 the flexing hook 90 returns to its original shape, withdrawing the barbed end 100 into the hook slot 91 and exposing the bend 101 in the shaft 98 through the opposite side of the hook slot 91. In one embodiment of the retention component 14 using a flexing hook 90, the flexing hook 90 includes a spring 102 at its attachment end 99 and a catch 103 along the bend 101 in its shaft 98. The spring 102 provides a force pulling the barbed end 100 of the flexing hook 90 into the hook slot 91 and exposing the bend 101 in the shaft 98. The catch 103 engages a lip 104 in the back side 95 of the hook slot 91 such that it stops the movement of the flexing hook 90 once the bend 101 in the shaft 98 is suitably exposed and the barbed end 100 is fully contained within the hook slot 91. A force applied to the bend 101 of the shaft 98 sufficient to counteract the force of the spring 102 causes the flexing hook 90 to be forced into the hook slot 91 as described above, exposing the barbed end 100. When the force is removed from the bend 101 of the shaft 98 the spring 102 causes the flexing hook 90 to withdraw into the hook slot 91 as described above. Another embodiment uses two flexing hooks 90, situated side by side within the hook slot 91, with both attached to the front side 94 of the hook slot 91 at their attachment ends 99. One of the flexing hooks 90 has its bend 101 exposed through the top side 96 of the hook slot 91, and the other flexing hook 90 has its bend 101 exposed through the bottom side 97 of the hook slot 91. This twin-hook embodiment permits symmetrical engagement of the retention component 14 with the target 8 with respect to the longitudinal axis of the arrow 1, thereby minimizing deflection of the flight of the arrow 1 as the detachable nock 9 engages and lodges into the target 8.

Figure 8:
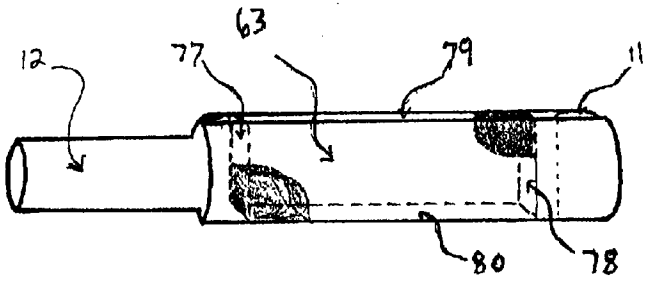
FIG. 8 is a side cut-away view of the grabber slot within the detachable nock.
Figure 9:
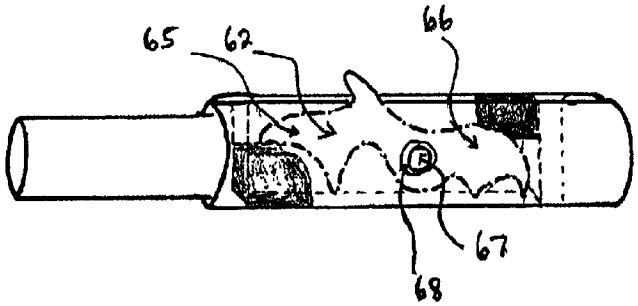
FIG. 9 is a side cut-away view of the pivoting grabber in the closed position situated within the grabber slot shown in FIG. 8.
Figure 10:
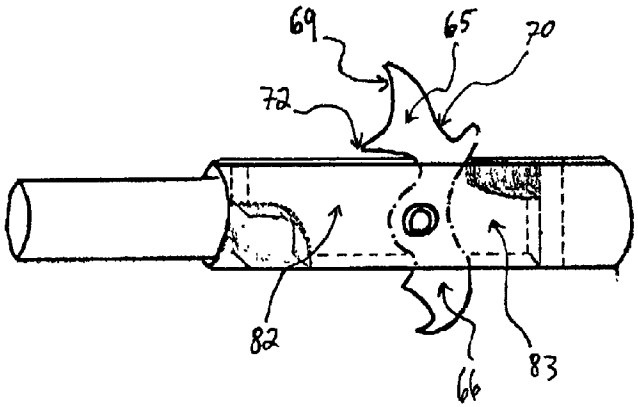
FIG. 10 is a side cut-away view of the pivoting grabber shown in FIG. 9 in the engaged position.

Yet another embodiment of the retention component 14 of the detachable nock 9 is shown in FIGS. 8–10. In this embodiment, the retention component 14 is situated substantially within the interior of the detachable nock 9 and upon contact with the target 8 is rotated out of the detachable nock 9 to engage and lodge into the target 8. While situated within the detachable nock 9 the retention component 14 presents a more aerodynamic profile than while in the engaged position, as well as protecting the user from barbs or other devices for engaging the target 8, and while in the engaged position the retention component 14 provides a greater ability to engage and lodge into the target 8.

In this embodiment the engaging component of the retention component 14 is situated within a grabber slot 63. The grabber slot 63 may be formed into the nock body 10, or into an extension 84 which is situated between the attachment component 12 and the nock body 10, and where the extension 84 is integrated with the attachment component 12 and is fixedly attached to the nock body 10. The grabber slot 63 has a left side 75, a right side 76, a front side 77, a back side 78, a top side 79, and a bottom side 80, with a uniform width between the left side 75 and the right side 76 and a uniform length between the front side 77 and the back side 78 such that the six sides 75, 76, 77, 78, 79, 80 define an open space aligned longitudinally with the intended direction of the flight of the arrow 1. A midpoint 81 located midway between the front side 77 and back side 78 and midway between the top side 79 and bottom side 80 defines a front section 82 of the grabber slot 63, situated between the midpoint 81 and the front side 77, and a rear section 83 of the grabber slot 63, situated between the midpoint 81 and the back side 80. The front section 82 is open along the top side 79 and partially closed along the bottom side 80. The rear section 83 is open along the bottom side 80 and may be partially closed along the top 79.

The engaging component of the retention component 14 is a pivoting grabber 62 which includes a pivot wheel 64, a catch arm 65, a grabbing arm 66, and a fulcrum 67. The pivot wheel 64 is composed of a rigid material, is substantially flat and substantially circular, and has a pivot aperture 68 in its center through which the fulcrum 67 passes. The catch arm 65 is composed of a rigid material and is fixedly attached to the pivot wheel 64. The grabbing arm 66 is composed of a rigid material and is fixedly attached to the pivot wheel 64 opposite the catch arm 65. The catch arm 65 and the grabbing arm 66 should form an oblique angle. Either or both the grabbing arm 66 or the catch arm 65 may be integrated into the pivot wheel 64. The fulcrum 67 is fixedly attached to the left side 75 and the right side 76 of the grabber slot 63 at the midpoint 81, rotationally attaching the pivot wheel 64 to the detachable nock 9 and allowing the pivot wheel 64 to rotate about the fulcrum 67. The catch arm 65 extends into the front section 82 of the grabber slot 63 and the grabbing arm 66 extends into the rear section 83 of the grabber slot 63. The pivoting grabber 62 may rotate forward and downward into the grabber slot 63 until it is stopped by the partial closure of the bottom side 80 of the front section 82. Likewise, the pivoting grabber 62 may rotate rearward and upward through the grabber slot 63 until it is stopped by the partial closure of the top side 79 of the rear section 83. Thus, the total rotation of the pivoting grabber 62 is approximately ninety degrees, from a substantially horizontal position contained substantially within the grabber slot 63, as shown in FIG. 9, to a substantially vertical position extended substantially external to the grabber slot 63, as shown in FIG. 10. When the pivoting grabber 62 is rotated forward and downward into the grabber slot 63, the catch arm 65 remains partially exposed external to the grabber slot 63. This exposed portion of the catch arm 65 engages the target 8 upon contact. As the arrow 1 continues through the target 8, the force of the target 8 against the catch arm 65 causes the pivoting grabber 62 to rotate and the catch arm 65 to rotate rearward and upward out of the grabber slot 63, thereby causing the grabber arm to simultaneously rotate forward and downward out of the grabber slot 63 to further engage the target 8. When fully rotated to the substantially vertical position, the catch arm 65 and the grabber arm most effectively engage and lodge into the target 8.

In one embodiment of the pivoting retention component 14, the catch arm 65 has a grabbing surface 69 and a non-grabbing surface 70, with each such surface situated opposite the other surface and running along the catch arm 65 from the pivot wheel 64 along the entire length of the catch arm 65. On the grabbing surface 69 of the catch arm 65 there may be situated one or more grabbing teeth 72. Similarly, the grabbing arm 66 has a grabbing surface 69 and a non-grabbing surface 70, with each such surface situated opposite the other surface and running along the catch arm 65 from the pivot wheel 64 along the entire length of the catch arm 65. On the grabbing surface 69 of the grabbing arm 66 there may be situated one or more grabbing teeth 72. In another embodiment, the catch arm 65 has a helical shape rotated along its longitudinal axis and the grabbing arm 66 has a helical shape rotated along its longitudinal axis in the opposite direction, thereby creating a propeller effect when the two arms are filly extended, causing the entire detachable nock 9 to rotate about its longitudinal axis resulting in greater engagement and lodging into the target 8. In yet another embodiment, the grabbing arm 66 is a barbed hook 73, with the shaft 105 of the hook 73 curved downward and forward so that the barbed end 106 of the hook 73 is directed forward. When the pivoting grabber 62 is rotated to a substantially horizontal position the barbed end 106 of the grabbing arm 66 is fully contained within the grabber slot 63. When the catch arm 65 engages the target 8 and rotates the pivoting grabber 62, the barbed end 106 of the grabbing arm 66 rotates downward and forward to engage and lodge in the target 8.

Figure 11:
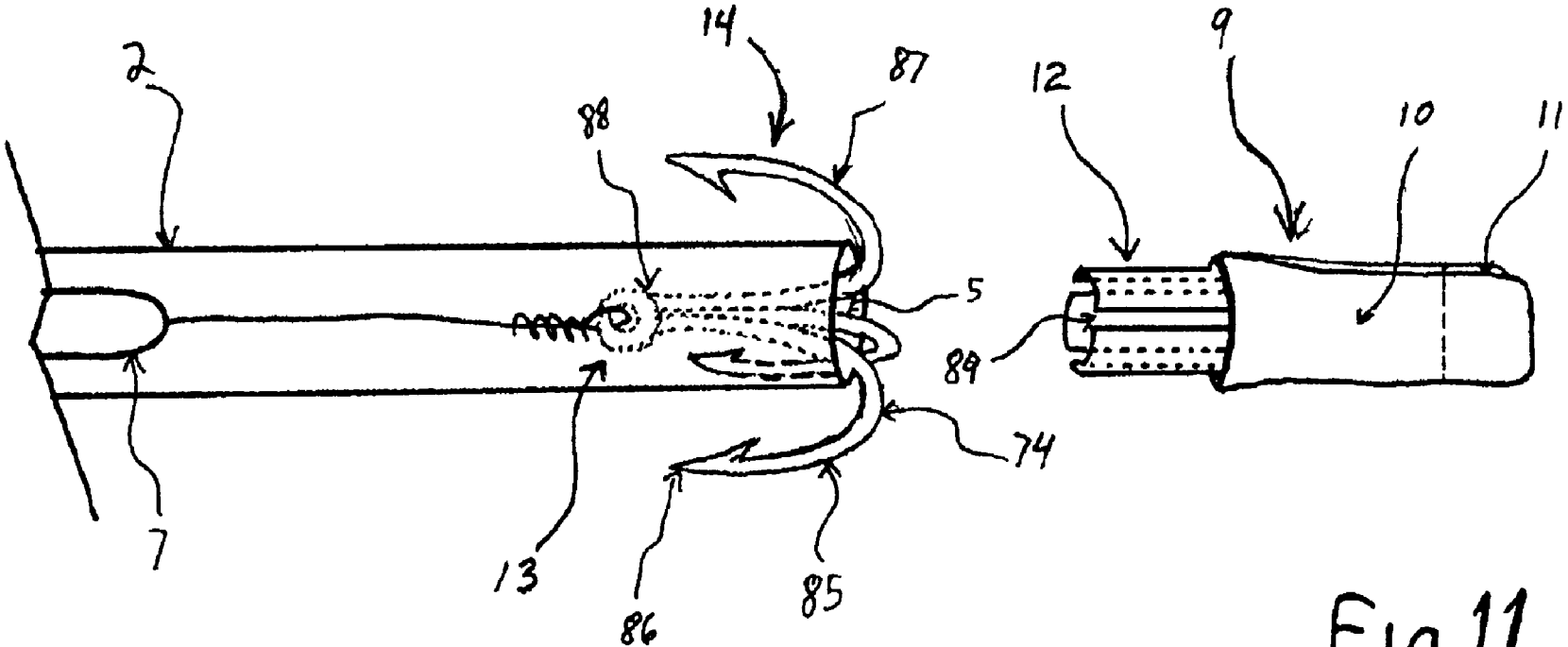
FIG. 11 is a cut-away view of the removable retention device and the detachable nock.

Another embodiment of the detachable nock 9 is shown in FIG. 11. In this embodiment, retention of the detachable nock 9 to the target 8 is accomplished by a retention device 14 separate from the detachable nock 9. The retention device 14 comprises a removable hook 85 having a shaft 87, an attachment end 88, and a barbed end 86. The shaft 87 of the removable hook 85 is curved forming a bend 75, so that the barbed end 86 of the removable hook 85 is directed towards the attachment end 88. The attachment end 88 of the removable hook 85 is attached to the locating device 7 and inserted into the arrow shaft 2. The barbed end 86 of the removable hook 85 remains external to the arrow shaft 2 and is forwardly directed towards the arrowhead 3. The attachment component 12 of the detachable nock 9 is then inserted into the arrow shaft 2, causing the removable hook 85 to be held in position between the attachment component 12 of the detachable nock 9 and the interior wall of the arrow shaft 2. When the retention device 14 engages and lodges into the target 8, the arrow 1 continues on its flight and the retention device 14 and the detachable nock 9 are detached from the arrow 1. In one embodiment the attachment component 12 of the detachable nock 9 includes a channel 89 situated substantially parallel to the intended direction of the flight of the arrow 1. This channel 89 accommodates the shaft 87 of the removable hook 85, permitting a snug fit of the detachable nock 9 into the arrow shaft 2. In another embodiment there may be multiple removable hooks 85, joined together at their attachment ends 88, with a corresponding number of channels 89 situated in the attachment component 12 of the detachable nock 9.

FIG. 3 shows a guidance component 20 which may be included with the detachable nock 9 for the purpose of permitting the locating device 7 to be cleanly removed from the arrow shaft 2. A guidance component 20 may be useful when a nock adapter 17 is used, since the inside edge of the nock adapter 17 may present a lip 21 or partial obstruction blocking the path of the locating device 7 as it is pulled from the arrow shaft 2. The guidance component 20 guides the locating device 7 past such lip 21 or obstruction. In one embodiment, the guidance component 20 is comprised of a flexible filament 22 with a plurality of flexible fibrous bristles 25. Each bristle 25 is slightly longer than one half the inside diameter of the arrow shaft 2, and the bristles 25 are situated substantially perpendicular to the filament 22 and arrayed around the filament 22 in a circular, radiating pattern, and along the length of the filament 22. The resulting effect resembles a bottle brush, or a pipe cleaner. When the guidance component 20 is inserted into the arrow shaft 2, the bristles 25 distort slightly, causing the filament 22 to be substantially centered within the hollow shaft 2 of the arrow 1. One end 107 of the filament 22 is attached to the anchor component 13 of the detachable nock 9 and the other end 108 of the filament 22 is attached to the locating device 7. As the detachable nock 9 detaches from the arrow 1 and the anchor component 13 draws the locating device 7 out of the arrow shaft 2, the guidance component 20 centers the locating device 7 within the arrow shaft 2 and allows it to pass cleanly through the nock adapter 17.

Figure 12:
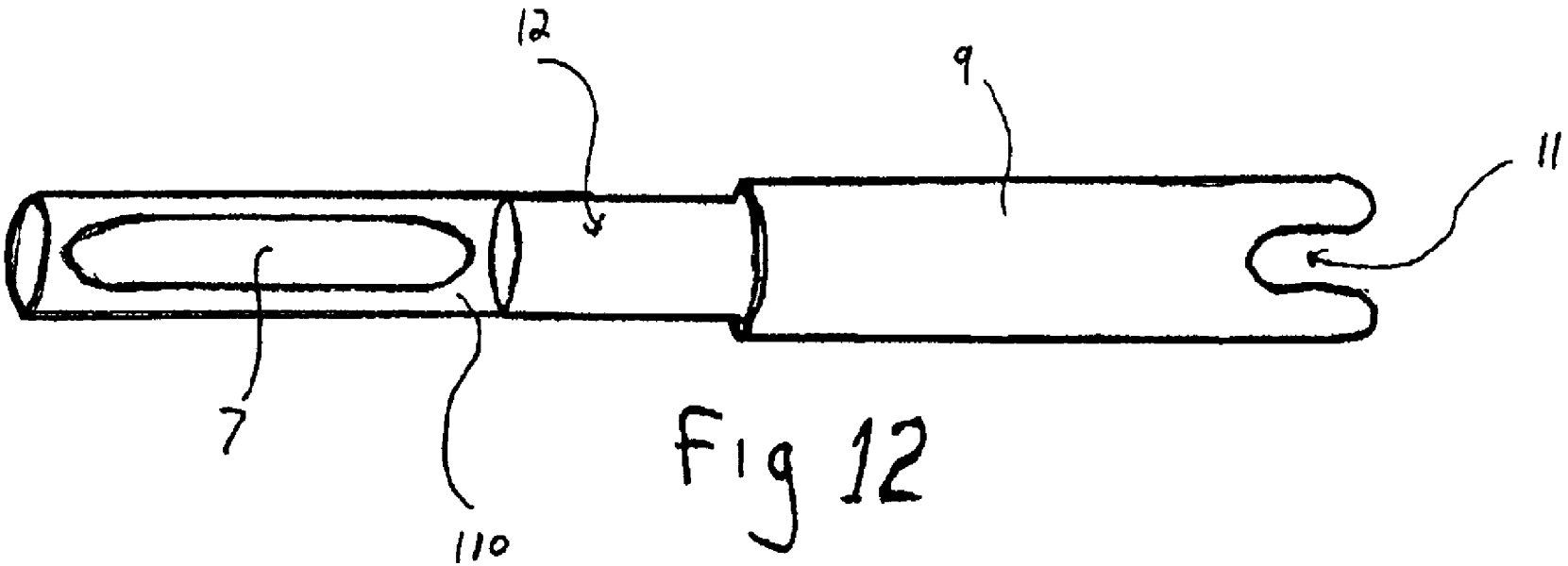
FIG. 12 is a top view of the carrying component of the detachable nock.

FIG. 12 shows a carrying component 110 which may be included with the detachable nock 9. The carrying component 110 is integrated into the attachment component 12 of the detachable nock 9 and is designed to accommodate the locating device 7 within its interior. The carrying component 110 is hollow, has a substantially cylindrical shape, and has a means for inserting the locating device 7 into its interior. When used the carrying component 110 eliminates the need to separate the locating device 7 from the detachable nock 9 and instead allows the hunter to use a single device with his or her arrow 1.

Among the advantages of the detachable nock 9 are the following. The ability to use a locating device 7 when bow hunting improves the chances of recovering the target animal 8 and reduces the chances of a wounded animal being left to die a lingering death. The detachable nock 9 improves the chances that a locating device 7 delivered by an arrow 1 will remain with the animal, thereby allowing the locating device 7 to work as intended. The embodiments of the detachable nock 9 which permit multiple points of engagement with the target 8 permit the detachable nock 9 to be detached from the arrow 1 with a reduced risk of deflecting the arrow 1 from its flight, which a single point of engagement may cause. A deflected arrow 1 may not cleanly pass through the target animal 8, thereby resulting in less blood loss and a slower death for the animal. Another advantage of the detachable nock 9 is its close conformity in size, shape, and weight to existing nocks, thereby minimizing its impact on the flight of the arrow 1. Bow hunters can also use their preferred model of arrow shaft 2 rather than an expensive custom designed arrow shaft 2. The simplicity of the design also allows for a cost-effective manufacture of the detachable nock 9.

Other embodiments not specifically set forth herein are also within the scope of the following claims.

What is claimed:

1. In an arrow having a hollow shaft with an arrowhead situated at the front end of the shaft and an arrow aperture being an aperture situated at the rear end of the shaft and the arrow containing a locating device within the hollow shaft, a device for removing the locating device from the arrow and securing the locating device to a target, comprising a detachable nock having a nock body;

a vertical notch to receive a bow string, situated at the rear of the detachable nock;

an attachment component for removably attaching the detachable nock to the arrow shaft;

an anchor component for attaching the locating device to the detachable nock; and a retention component for securing the detachable nock to the target;

whereby the retention component engages and lodges into the target and in combination with the anchor component removes the locating device from the arrow and secures the locating device to the target.

2. The device of claim 1, wherein the attachment component of the detachable nock is an extension of the nock body projecting from the front of the nock body and aligned longitudinally with the intended direction of the flight of the arrow and having a substantially cylindrical shape, and further comprising an insertion end and a base end, with the insertion end being furthest from the nock body and the base end being nearest and integrated into the nock body.

3. The device of claim 2, wherein the insertion end of the attachment component has a diameter just slightly smaller than the inside diameter of the arrow aperture.

4. The device of claim 1, wherein the attachment component of the detachable nock is an extension of the nock body projecting from the front of the nock body and aligned longitudinally with the intended direction of the flight of the arrow and having a size and shape adapted to fit into a nock adapter, which is secured to the inside of the arrow aperture, and further comprising an insertion end and a base end, with the insertion end being furthest from the nock body and the base end being nearest and integrated into the nock body.

5. The device of claim 1, wherein the anchor component of the detachable nock further comprises an anchor device having a first end and a second end, with the first end attached to the locating device.

6. The device of claim 5, wherein the anchor component of the detachable nock further comprises a loop attached to the insertion end of the attachment component, whereby the second end of the anchor device is attached to the loop.

7. The device of claim 6, wherein the loop of the anchor component of the detachable nock has a substantially circular shape and the diameter of the circle formed by the loop is smaller than the diameter of the insertion end of the attachment component.

8. The device of claim 5, wherein the anchor component of the detachable nock further comprises an anchor aperture being an aperture through the insertion end of the attachment component situated substantially perpendicular to the longitudinal axis of the attachment component and having a first opening situated on the surface of the insertion end and a second opening situated at the opposite end of the anchor aperture on the surface of the insertion end, whereby the second end of the anchor device is placed through the anchor aperture and secured to itself.

9. The device of claim 8, wherein the anchor component of the detachable nock further comprises:

a first channel, situated parallel to the longitudinal axis of the attachment component and originating at the first opening of the anchor aperture and continuing for the remaining length of the insertion end;

a second channel, situated parallel to the first channel and to the longitudinal axis of the attachment component, and originating at the second opening of the anchor aperture and continuing for the remaining length of the insertion end;

whereby the anchor device is situated within the first channel prior to entering the anchor aperture and situated within the second channel after exiting the anchor aperture.

10. The device of claim 5, wherein the anchor component of the detachable nock further comprises a central aperture through the insertion end of the attachment component situated substantially coaxially with the longitudinal axis of the attachment component and having a substantially cylindrical shape;

an open end situated at the front of the attachment component allowing for communication through the central aperture to the exterior of the attachment component;

a terminal end situated within the interior of the attachment component and at the opposite end of the central aperture as the open end; and a uniform inside diameter.

11. The device of claim 10, further comprising:

an entry aperture through the insertion end of the attachment component situated substantially perpendicular to the central aperture and having a substantially cylindrical shape, an open end situated at the surface of the attachment component allowing for communication through the entry aperture to the exterior of the attachment component, a terminal end situated within the interior of the attachment component and at the opposite end of the entry aperture as the open end, being coextensive with the terminal end of the central aperture, and a uniform inside diameter, being just slightly greater than the inside diameter of the central aperture; and an anchor bead having a spherical shape and a diameter just slightly greater than the inside diameter of the central aperture and a diameter just slightly smaller than the inside diameter of the entry aperture;

wherein the second end of the anchor device is placed within the central aperture and situated at the terminal end of the entry aperture and is attached to the anchor bead, which is situated within the terminal end of the entry aperture.

12. The device of claim 10, wherein the anchor component of the detachable nock further comprises a retaining pin within the insertion end of the attachment component situated substantially perpendicular to the central aperture and having a placement end situated at the surface of the insertion end;

a retaining end situated within the terminal end of the central aperture; and a means for placing the retaining pin into and out of the insertion end;

whereby the second end of the anchor device is inserted through the open end of the central aperture and into the terminal end of the central aperture.

13. The device of claim 12, wherein the second end of the anchor device is placed within the central aperture and attached to the retaining end of the retaining pin.

14. The device of claim 13, wherein the means for placing the retaining pin into and out of the insertion end comprises:

the retaining pin being a screw;

the insertion end having a threaded aperture to receive the retaining pin; and the placement end adapted to accommodate a screwdriver or other like device.

15. The device of claim 12, further comprising an anchor bead having a spherical shape and a diameter just slightly smaller than the inside diameter of the central aperture, wherein the second end of the anchor device is placed within the central aperture and attached to the anchor bead and the anchor bead is situated within the terminal end of the central aperture such that the retaining end of the retaining pin is situated between the anchor bead and the open end of the central aperture.

16. The device of claim 5, wherein the anchor component of the detachable nock further comprises:

a first interlocking part; and a second interlocking part;

wherein the first interlocking part removably attaches to the second interlocking part and the first interlocking part is attached to the attachment component and the second interlocking part is attached to the second end of the anchor device.

17. The device of claim 5, wherein the anchor device serves as an antenna for the locating device.

18. The device of claim 1, wherein the retention component of the detachable nock further comprises a fixed hook fixedly attached to the detachable nock, having:

a shaft;

an attachment end; and a barbed end;

whereby the attachment end of the fixed hook is fixedly attached to the nock body and the shaft of the fixed hook is curved towards the front of the detachable nock such that the barbed end of the fixed hook is forwardly directed towards the arrowhead and situated substantially in a plane aligned with the intended direction of the flight of the arrow.

19. The device of claim 18, further comprising a plurality of fixed hooks for engaging and lodging into the target.

20. The device of claim 1, wherein the retention component of the detachable nock further comprises a hinged hook having:

a grabbing prong, having a barbed end, a shaft, and a hinged end; and an anchor pin, having two ends whereby the first end is fixedly attached to the nock body and a hinge point is situated at the second end;

whereby the hinged end of the grabbing prong is movably attached to the anchor pin at the hinge point such that the grabbing prong pivots forward and backward in a plane aligned with the intended direction of the flight of the arrow, and the shaft of the grabbing prong is curved back toward itself forming a bend such that the barbed end is directed towards the hinged end.

21. The device of claim 20, further comprising a torsion spring integrated into the hinged end of the grabbing prong and the hinge point of the anchor pin.

22. The device of claim 21, further comprising a plurality of hinged hooks for engaging and lodging into the target.

23. The device of claim 20, further comprising a perpendicular aperture being an aperture passing through the detachable nock and situated substantially perpendicular to the longitudinal axis of the detachable nock; and an anchor pin slightly greater in length than the length of the perpendicular aperture, wherein a hinge point is situated at the first end of the anchor pin;

whereby the anchor pin is situated fixedly within the perpendicular aperture and both the first end and the second end of the anchor pin extend from the nock body, and a grabbing prong is movably attached to the anchor pin at the hinge point of the first end and another grabbing prong is movably attached to the anchor pin at the hinge point of the second end.

24. The device of claim 20, wherein the retention component of the detachable nock further comprises a barb guard.

25. The device of claim 24, wherein the barb guard comprises a first guard wall composed of a flat, semi-rigid material and having at least one straight edge; and a second guard wall composed of a flat, semi-rigid material and having at least one straight edge;

whereby the first guard wall is attached along its straight edge perpendicularly to the detachable nock in front of the hinged hook (or to the arrow shaft to accommodate a hinged hook with a longer shaft) and is situated substantially parallel to a plane aligned with the intended direction of the flight of the arrow, and the second guard wall is attached along its straight edge perpendicularly to the detachable nock in front of the hinged hook (or to the arrow shaft to accommodate a hinged hook with a longer shaft) and adjacent to the first guard wall and is situated substantially parallel to the first guard wall and to a plane aligned with the intended direction of the flight of the arrow, such that a small separation exists between the surfaces of the first guard wall and the second guard wall which accommodates the barbed end of the grabbing prong when the grabbing prong is positioned forward and the barbed end is inserted between the first guard wall and the second guard wall.

26. The device of claim 25, wherein the barb guard further comprises a device for maintaining the barbed end of the grabbing prong within the barb guard until the target is engaged.

27. The device of claim 26, wherein the device for maintaining the barbed end of the grabbing prong within the barb guard is a removable clip situated over and compressing together the first guard wall and the second guard wall.

28. The device of claim 27, further comprising a plurality of barb guards for accommodating a like number of hinged hooks.

29. The device of claim 1, wherein the retention component of the detachable nock further comprises a flexing hook situated within a hook slot formed within the detachable nock, with the flexing hook having a shaft, an attachment end, and a barbed end and with the shaft of the flexing hook curved back toward itself forming a bend, such that the barbed end of the flexing hook points generally in the same direction as the attachment end of the flexing hook;

and with the hook slot formed into the interior of the detachable nock, having a left side, a right side, a front side, a back side, a top side, and a bottom side, with the left side, right side, front side, and back side being solid surfaces and the top side and bottom side being open such that the six sides define an open space aligned longitudinally with the intended direction of the flight of the arrow, and having a uniform width between the left side and the right side slightly greater than the thickness of the flexing hook and having a uniform length between the front side and the back side slightly greater than the length of the flexing hook;

whereby the attachment end of the flexing hook is attached to the front side of the hook slot such that a portion of the bend in the shaft of the flexing hook extends out of the hook slot and the barbed end remains within the hook slot directed towards the front of the arrow.

30. The device of claim 29, wherein the flexing hook further comprises a spring at its attachment end and a catch along the bend in its shaft, and the hook slot further comprises a lip in its back side, whereby the spring provides a force pulling the barbed end of the flexing hook into the hook slot and the catch engages the lip in the back side of the hook slot.

31. The device of claim 30, further comprising two flexing hooks situated adjacent to each other with their shaft bends protruding from opposite sides of the hook slot.

32. The device of claim 1, wherein the retention component of the detachable nock further comprises a pivoting grabber situated within a grabber slot, with the pivoting grabber having:

a pivot wheel;

a catch arm;

a grabbing arm; and a fulcrum;

wherein the pivot wheel is composed of a rigid material, is substantially flat and substantially circular, and having a pivot aperture being a small aperture in its center through which the fulcrum passes;

the catch arm is composed of a rigid material and is fixedly attached to the pivot wheel;

the grabbing arm is composed of a rigid material and is fixedly attached to the pivot wheel opposite the catch arm such that the catch arm and the grabbing arm form an oblique angle; and the fulcrum passes through the pivot aperture and is fixedly attached to the detachable nock within the grabber slot, rotationally attaching the pivot wheel to the detachable nock and allowing the pivot wheel to rotate about the fulcrum.

33. The device of claim 32, wherein the catch arm has a grabbing surface and a non-grabbing surface, each such surface situated opposite the other such surface and running along the catch arm from the pivot wheel along the entire length of the catch arm, and with one or more grabbing teeth situated along the grabbing surface of the catch arm; and the grabbing arm has a grabbing surface and a non-grabbing surface, each such surface situated opposite the other such surface and running along the grabbing arm from the pivot wheel along the entire length of the grabbing arm, and with one or more grabbing teeth situated along the grabbing surface of the grabbing arm.

34. The device of claim 33, wherein the catch arm has a helical shape rotated along its longitudinal axis and the grabbing arm has a helical shape rotated along its longitudinal axis in the opposite direction.

35. The device of claim 32, wherein the grabbing arm is a barbed hook.

36. The device of claim 32, wherein the grabber slot is formed in the interior of the detachable nock, having a left side, a right side, a front side, a back side, a top side, and a bottom side;

a uniform width between the left side and the right side slightly greater than the thickness of the pivoting grabber and a uniform length between the front side and the back side slightly greater than the length of the pivoting grabber such that the six sides define an open space aligned longitudinally with the intended direction of the flight of the arrow;

a midpoint located midway between the front side and back side and midway between the top side and bottom side;

a front section of the grabber slot situated between the midpoint and the front side, being open along the top side and closed along the bottom side; and a rear section of the grabber slot situated between the midpoint and the back side, being open along the bottom side;

whereby the fulcrum is attached to the left side and the right side of the grabber slot at the midpoint and the pivot wheel is situated on the fulcrum such that the catch arm extends into the front section of the grabber slot and the grabbing arm extends into the rear section of the grabber slot, such that in the closed position the pivoting grabber is contained within the grabber slot except for the catch arm, which extends from the top side of the front section of the grabber slot, and such that the pivoting grabber can be pivoted to the open position, with the catch arm rotating upward and backward out through the open top side of the front section until reaching a substantially vertical position and the grabbing arm rotating downward and forward out through the open bottom side of the rear section until reaching a substantially vertical position, but with the pivoting grabber being prevented from rotating in the opposite direction by the closed bottom of the front section.

37. The device of claim 36, wherein the grabber slot is formed into the nock body.

38. The device of claim 36, wherein the retention component of the detachable nock further comprises an extension component, situated between the attachment component and the nock body, whereby the extension component is integrated with the attachment component and is fixedly attached to the nock body and where the grabber slot is formed into the extension component.

39. The device of claim 1, wherein the detachable nock further comprises a guidance component which permits the detachable nock to cleanly remove the locating device from the arrow.

40. The device of claim 39, wherein the guidance component comprises a flexible filament with a plurality of flexible fibrous bristles, whereby each bristle is slightly longer than one half the inside diameter of the arrow shaft, and the bristles are situated substantially perpendicular to the filament and arrayed around the filament in a circular, radiating pattern, and along the length of the filament, and with one end of the filament attached to the anchor component and the other end of the filament attached to the locating device.

41. The device of claim 1, wherein the detachable nock further comprises a carrying component, wherein the carrying component is integrated into the attachment component of the detachable nock and is designed to accommodate the locating device within its interior.

42. The device of claim 41, wherein the carrying component is hollow, has a substantially cylindrical shape, and has a means for inserting the locating device into the interior of the carrying component.

43. In an arrow having a hollow shaft with an arrowhead situated at the front end of the shaft and an arrow aperture being an aperture situated at the rear end of the shaft and the arrow containing a locating device within the hollow shaft, a device for removing the locating device from the arrow and securing the locating device to a target, comprising a detachable nock having a nock body, a vertical notch to receive a bow string, situated at the rear of the detachable nock, and an attachment component for removably attaching the detachable nock to the arrow shaft; and a retention device for securing the locating device to the target;

whereby the retention device engages and lodges into the target and in combination with the anchor component removes the locating device from the arrow and secures the locating device to the target.

44. The device of claim 43, wherein the retention device comprises a removable hook having:

a shaft;

an attachment end; and a barbed end;

whereby the attachment end of the removable hook is attached to the locating device and the shaft of the removable hook extends backward from the attachment end towards the rear of the arrow and then is curved forward towards the front of the arrow such that the barbed end of the removable hook is forwardly directed towards the arrowhead and situated substantially in a plane aligned with the intended direction of the flight of the arrow, and the shaft of the removable hook is situated within the arrow shaft between the inside wall of the arrow shaft and the attachment component of the detachable nock once the detachable nock is inserted into the arrow shaft, causing the removable hook to be held in position between the attachment component of the detachable nock and the interior wall of the arrow shaft.

45. The device of claim 44, wherein the attachment component of the detachable nock further comprises a channel situated substantially parallel to the intended direction of the flight of the arrow and which accommodates the shaft of the removable hook.

46. The device of claim 45, further comprising a plurality of removable hooks for engaging and lodging into the target joined at their attachment ends, along with a corresponding number of channels in the attachment component of the detachable nock to accommodate the shafts of the removable hooks.

* * * * *